US008827424B2

(12) United States Patent
Fukai et al.

(10) Patent No.: US 8,827,424 B2
(45) Date of Patent: Sep. 9, 2014

(54) LIQUID EJECTION HEAD

(75) Inventors: Hisashi Fukai, Yokohama (JP); Naoki Nakajo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 51 days.

(21) Appl. No.: 13/595,166

(22) Filed: Aug. 27, 2012

(65) Prior Publication Data

US 2013/0050345 A1 Feb. 28, 2013

(30) Foreign Application Priority Data

Aug. 31, 2011 (JP) ..... 2011-189346

(51) Int. Cl.
*B41J 2/14* (2006.01)
*B41J 2/04* (2006.01)
*B41J 2/16* (2006.01)

(52) U.S. Cl.
CPC ..... *B41J 2/14072* (2013.01); *B41J 2/1623* (2013.01); *B41J 2/1601* (2013.01)
USPC ..... 347/50; 347/54

(58) Field of Classification Search
None
See application file for complete search history.

(56) References Cited

U.S. PATENT DOCUMENTS 5,442,386 A * 8/1995 Childers et al. ..... 347/50
2002/0003556 A1 1/2002 Mori
2011/0148987 A1 6/2011 Toda

FOREIGN PATENT DOCUMENTS

JP 2002-019120 A 1/2002
JP 2006-212902 A 8/2006
JP 2010-284813 A 12/2010

* cited by examiner

*Primary Examiner* — Geoffrey Mruk
(74) *Attorney, Agent, or Firm* — Canon U.S.A., Inc., IP Division

(57) ABSTRACT

A liquid ejection head includes a recording element substrate including an ejection port that ejects liquid, and an energy generating element that generates energy used to eject liquid, an electric wiring substrate including wiring for transmitting electric power for driving the energy generating element, and an opening that exposes the recording element substrate, a plurality of connecting portions that electrically connect the recording element substrate and the electric wiring substrate, a recess formed between the recording element substrate and the electric wiring substrate, and at least one groove formed in the bottom of the recess corresponding to at least one part where the connecting portions are formed. The at least one groove includes a first portion formed along an arranging direction of the plurality of connecting portions, and a second portion formed in a direction intersecting with the arranging direction.

9 Claims, 9 Drawing Sheets

FIG. 5C
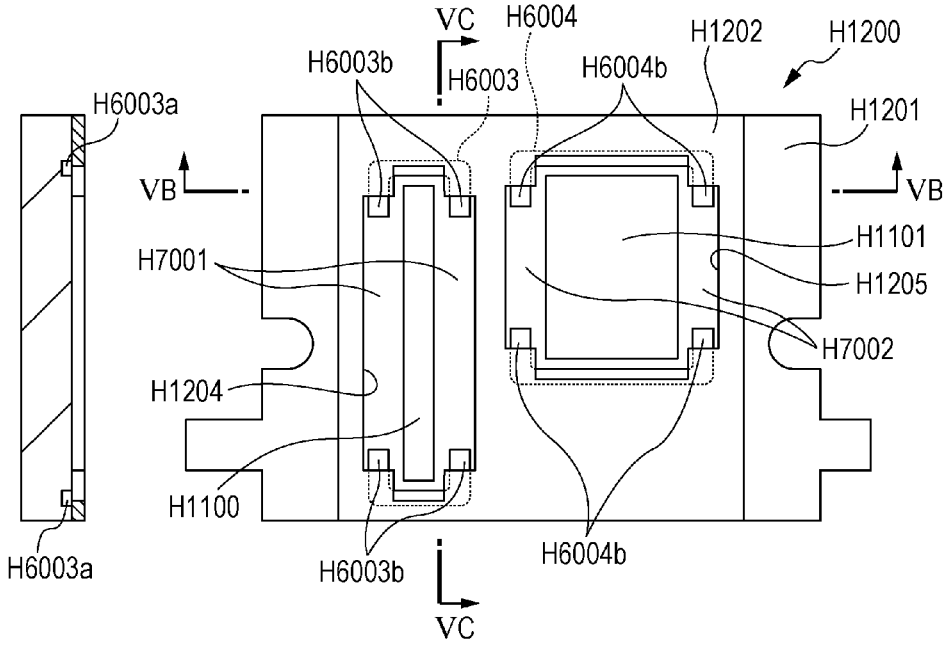
FIG. 5A
FIG. 5B
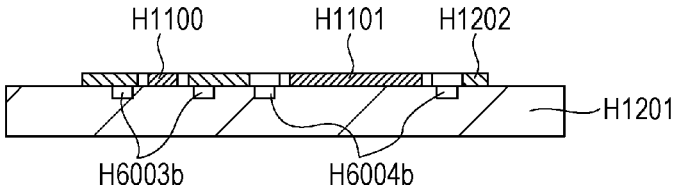

PRIOR ART

LIQUID EJECTION HEAD

BACKGROUND OF THE INVENTION

1. Field of the Invention

The present invention relates to a liquid ejection head.

2. Description of the Related Art

A typical liquid ejection head is disclosed in Japanese Patent Laid-Open No. 2002-019120. FIGS. 11A, 11B, and 11C are schematic configuration diagrams of the typical liquid ejection head disclosed in Japanese Patent Laid-Open No. 2002-019120. FIG. 11A is a perspective view, FIG. 11B is an enlarged sectional view taken along line XIB-XIB of FIG. 11A, and FIG. 11C is an enlarged sectional view taken along line XIC-XIC of FIG. 11A.

The liquid ejection head 100 can be mounted in a recording apparatus main body (not shown) that performs recording on a recording medium such as paper. As shown in FIG. 11A, the liquid ejection head 100 includes two rectangular recording element substrates 1*a* and 1*b* and a supporting substrate 8 that supports the recording element substrates 1*a* and 1*b*.

The liquid ejection head 100 includes an electric contact substrate 16 and an electric wiring substrate 11 for transmitting electric pulse signals from the recording apparatus main body to the recording element substrates 1*a* and 1*b* when the liquid ejection head 100 is mounted in the recording apparatus main body. The electric wiring substrate 11 is supported by the supporting substrate 8.

As shown in FIG. 11B and FIG. 11C, the recording element substrate 1*a* includes a substrate 2 and an ejection port plate 5 formed so as to cover the substrate 2. Ejection energy generating elements 4 that are electrothermal transducers are provided on the substrate 2. Ejection ports 6 are formed in the ejection port plate 5 so as to face the ejection energy generating elements 4.

A recess 17 is formed between the four sides of the recording element substrate 1*a* and a supporting plate 9. A groove 28 narrower than the recess 17 is formed in part of the supporting substrate 8 corresponding to the recess 17. Thus, the recording element substrate 1*a* is completely surrounded by the recess 17 and the groove 28.

As shown in FIG. 11C, electrode terminals 13 that electrically connect the recording element substrate 1*a* and the electric wiring substrate 11 are disposed over the recess 17. In response to an electric pulse signal transmitted from the electric wiring substrate 11, the recording element substrate 1*a* drives the ejection energy generating elements 4 and ejects ink from the ejection ports 6.

When the liquid ejection head 100 is manufactured, first sealing resin 18 is injected in an uncured state into the recess 17 by a dispense method. The uncured first sealing resin 18 injected into the recess 17 flows owing to capillary action along the groove 28 and fills the recess 17. The first sealing resin 18 filling the recess 17 is cured by being heated.

In the liquid ejection head 100, the corrosion of the supporting substrate 8 by ink and a short circuit between the recording element substrate 1*a* and the electric wiring substrate 11 due to ink can be prevented by the first sealing resin 18.

In addition, as shown in FIG. 11C, layers of second sealing resin 19 are formed so as to cover the electrode terminals 13. When the liquid ejection head 100 is manufactured, the second sealing resin 19 is applied in an uncured state to the electrode terminals 13 and is then cured by being heated as with the first sealing resin 18.

In the liquid ejection head 100, the electrode terminals 13 can be protected by the second sealing resin 19, and the corrosion or the like of the electrode terminals 13 by ink can be prevented.

When the liquid ejection head 100 shown in FIGS. 11A to 11C is manufactured, as described above, uncured first sealing resin 18 is injected into the recess 17 over the groove 28. At that time, since the groove 28 is narrow, owing to the surface tension or the like of the uncured first sealing resin 18, sometimes the uncured first sealing resin 18 does not enter some parts of the groove 28 from the recess 17.

In such a case, after the recess 17 is filled with the uncured first sealing resin 18, air remains in the uncured first sealing resin 18. The air in the uncured first sealing resin 18 forms bubbles, and sometimes the bubbles grow up to 1 mm or more in diameter.

If the bubbles burst in the uncured first sealing resin 18, the uncured first sealing resin 18 may be scattered about and may adhere to the recording element substrate 1*a* and the like. This may prevent the recording element substrate 1*a* from appropriately ejecting ink.

When the first sealing resin 18 and the second sealing resin 19 are heated to cure them, sometimes the bubbles in the first sealing resin 18 move into the second sealing resin 19. In this case, a gap may be formed between the electrode terminals 13 and the second sealing resin 19 covering them and may cause defective sealing of the electrode terminals 13. The liquid ejection head described in Japanese Patent Laid-Open No. 2002-019120 has such problems.

SUMMARY OF THE INVENTION

In an aspect of the present invention, a liquid ejection head includes a recording element substrate including an ejection port that ejects liquid, and an energy generating element that generates energy used to eject liquid, an electric wiring substrate including wiring for transmitting electric power for driving the energy generating element, and an opening that exposes the recording element substrate, a plurality of connecting portions that electrically connect the recording element substrate and the electric wiring substrate, a recess formed between the recording element substrate and the electric wiring substrate, and at least one groove formed in the bottom of the recess corresponding to at least one part where the connecting portions are formed. The at least one groove includes a first portion formed along an arranging direction of the plurality of connecting portions, and a second portion formed in a direction intersecting with the arranging direction.

Further features of the present invention will become apparent from the following description of exemplary embodiments with reference to the attached drawings.

BRIEF DESCRIPTION OF THE DRAWINGS

FIGS. 5A, 5B, and 5C are diagrams showing the state of the liquid ejection head shown in FIG. 1 during manufacturing.

DESCRIPTION OF THE EMBODIMENTS

Next, an embodiment of the present invention will be described with reference to the drawings.

Figure 1:
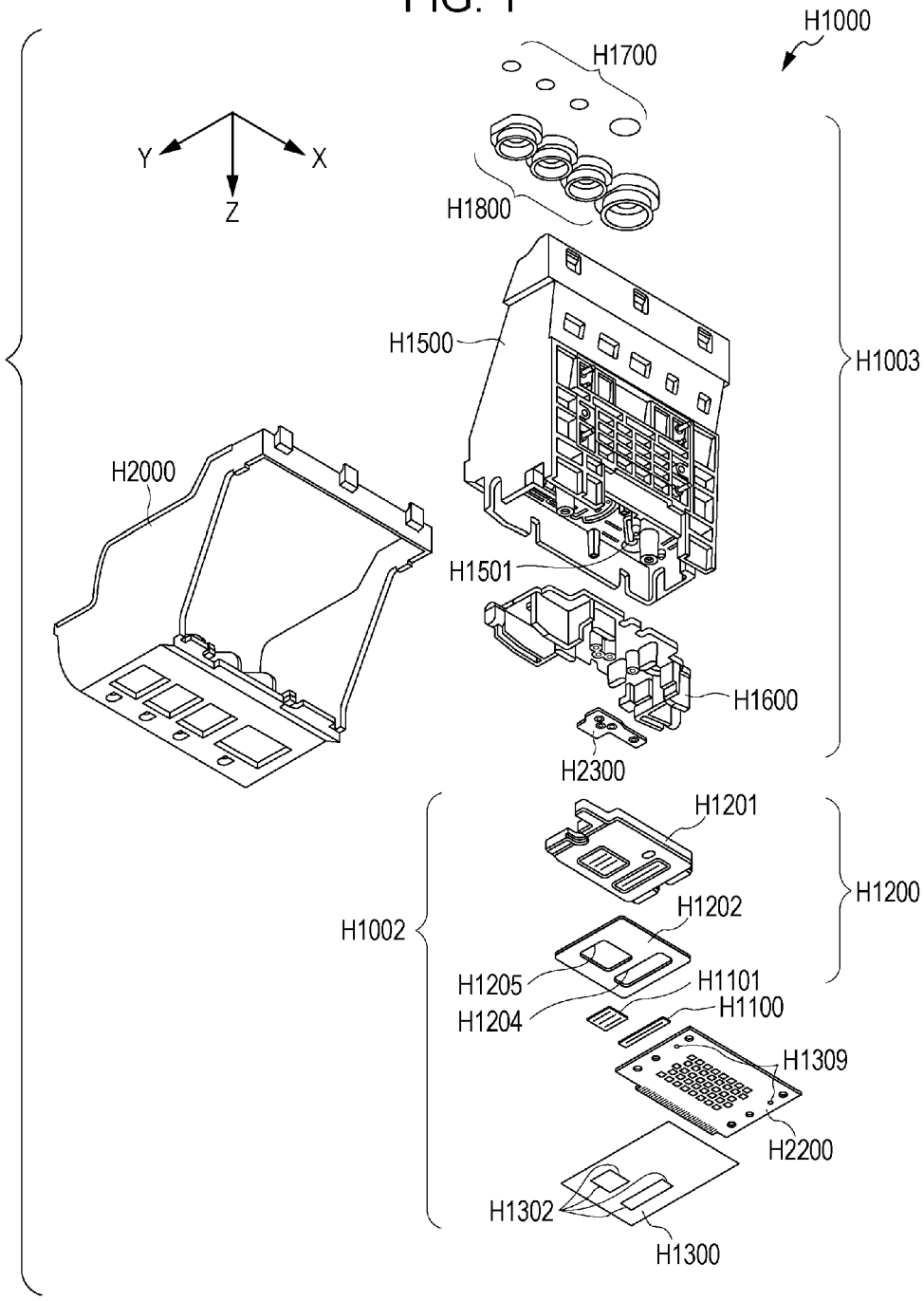
FIG. 1 is an exploded perspective view of a liquid ejection head according to an embodiment.

FIG. 1 is an exploded perspective view of a liquid ejection head H1000 according to an embodiment. The liquid ejection head H1000 can be mounted in a recording apparatus main body (not shown) that performs recording on a recording medium such as paper. The liquid ejection head H1000 includes two units: a recording element unit H1002 and an ink supply unit H1003.

A tank holder H2000 that holds an ink tank (not shown) that stores ink to be supplied to the recording element unit H1002 is detachably attached to the ink supply unit H1003. The ink supply unit H1003 is configured to supply ink in the ink tank attached to the tank holder H2000 to the recording element unit H1002.

Specifically, the ink supply unit H1003 includes an ink supply member H1500, a flow passage forming member H1600, a joint rubber H2300, filters H1700, and seal rubbers H1800.

The recording element unit H1002 includes two rectangular recording element substrates H1100 and H1101 and a supporting member H1200 including a supporting substrate H1201 and a supporting plate H1202. The recording element substrates H1100 and H1101 are held by supporting portions of the supporting substrate H1201. Ink supply passages for sending ink supplied from the ink supply unit H1003 to the recording element substrates H1100 and H1101 are formed in the supporting member H1200.

The recording element unit H1002 includes an electric contact substrate H2200 and an electric wiring substrate H1300 for transmitting electric pulse signals and electric power from the recording apparatus main body in which the liquid ejection head H1000 is mounted to the recording element substrates H1100 and H1101.

Figure 2:
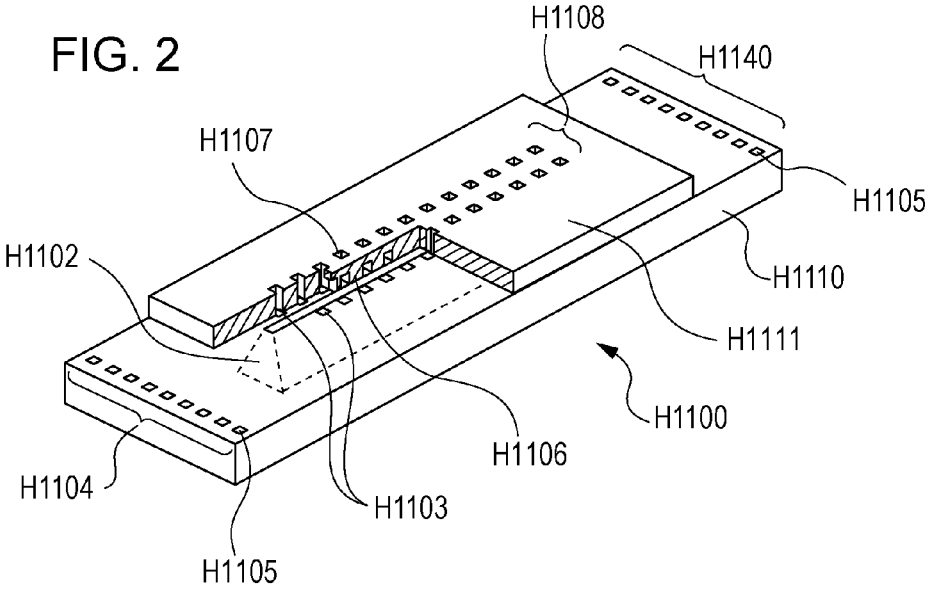
FIG. 2 is a perspective views of the recording element substrate shown in FIG. 1.
Figure 3:
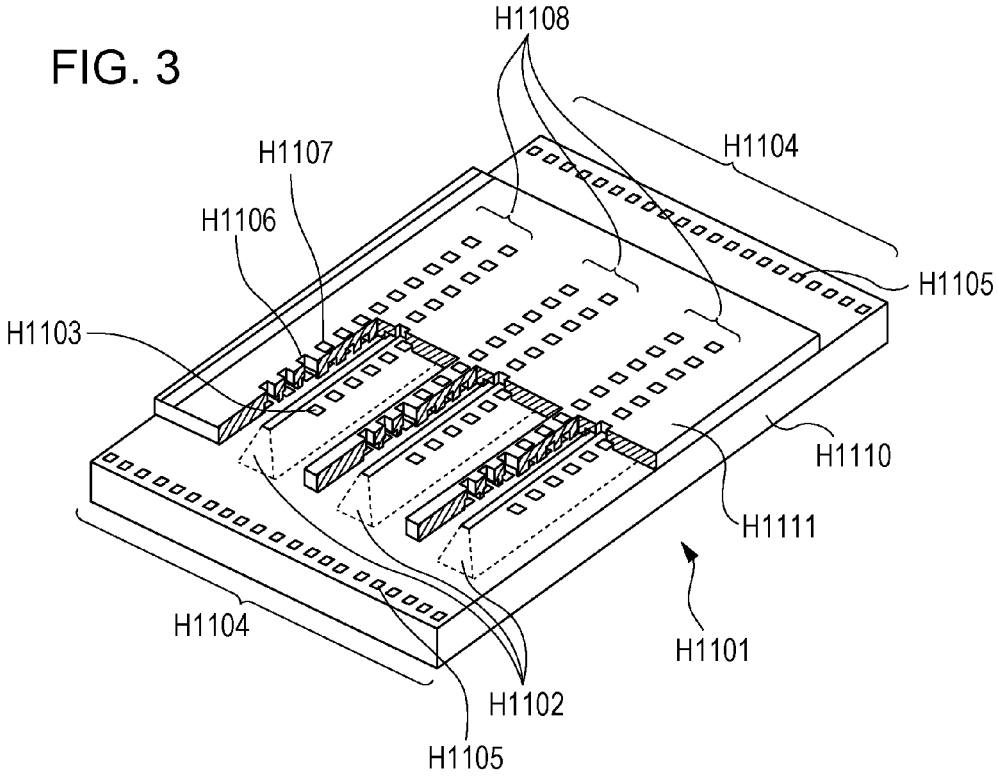
FIG. 3 is a perspective views of the recording element substrate shown in FIG. 1.

FIG. 2 and FIG. 3 are partial cutaway perspective views of the recording element substrate H1100 and the recording element substrate H1101. The recording element substrates H1100 and H1101 each include a silicon substrate H1110 having a thickness of about 0.5 mm to 1 mm. The silicon substrate H1110 of the recording element substrate H1100 has an ink supply port H1102 formed therethrough. The silicon substrate H1110 of the recording element substrate H1101 has ink supply ports H1102 formed therethrough. The ink supply ports H1102 are formed by anisotropic etching using the crystal orientation of the silicon.

The liquid ejection head H1000 is a side shooter type bubble jet head. In each of the recording element substrates H1100 and H1101, a plurality of electrothermal transducers H1103 that are energy generating elements that generate energy used for ejecting liquid are arranged. The electrothermal transducers H1103 are arranged on the upper surface of the silicon substrate H1110 along the ink supply port or ports H1102 in a staggered manner.

On the upper surface of the silicon substrate H1110, an ejection port plate H1111 is provided. The ejection port plate H1111 has ejection ports H1107 formed so as to face the electrothermal transducers H1103, and ink flow passage walls H1106 that form ink flow passages for leading ink supplied to the ink supply port or ports H1102 to the ejection ports H1107.

The electrothermal transducers H1103 are connected to electrodes H1104 arranged along the two sides at both ends of the silicon substrate H1110. The electrothermal transducers H1103, and wiring (not shown) connecting the electrothermal transducers H1103 and the electrodes H1104 are formed by a film formation technique. On each electrode H1104, a bump H1105 is formed of gold.

In response to electric pulse signals from the recording apparatus main body, the electrothermal transducers H1103 generate thermal energy and cause film boiling in ink. Thus, ink is ejected from the ejection ports H1107.

Figure 4A:
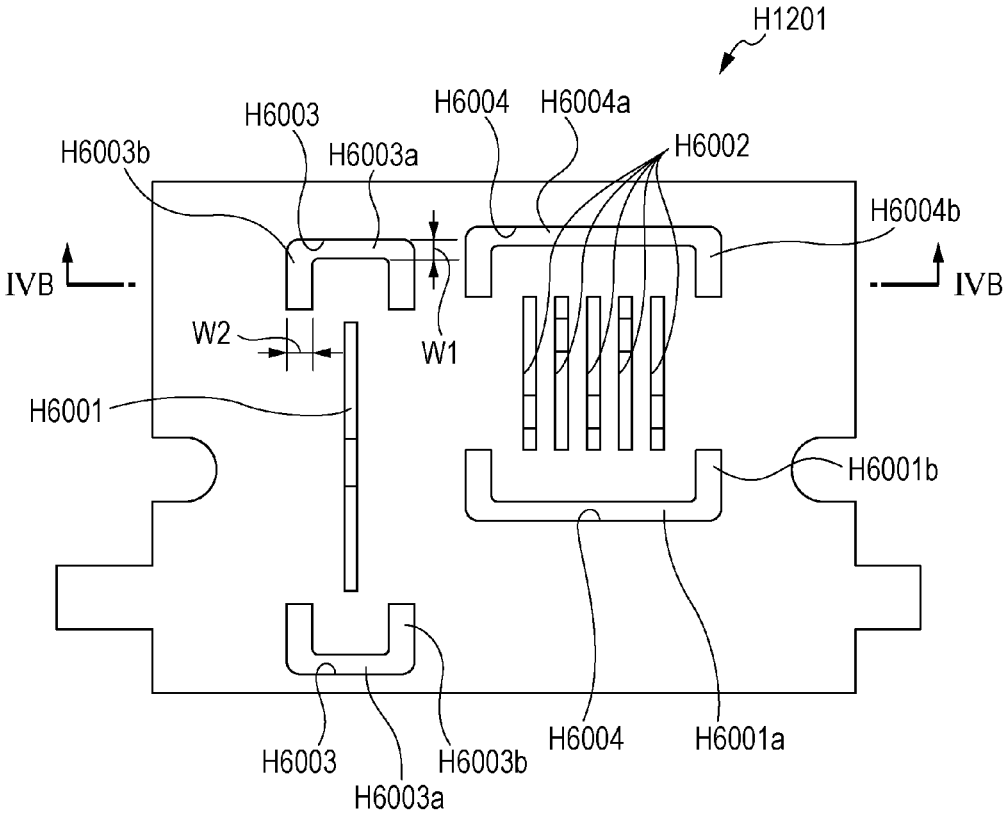
FIGS. 4A and 4B are schematic configuration diagrams of the supporting substrate shown in FIG. 1.
Figure 4B:
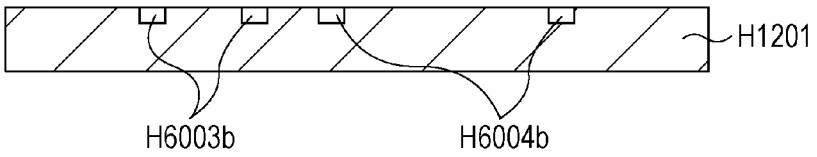

FIGS. 4A and 4B are enlarged views of the supporting substrate H1201 of the recording element unit H1002 shown in FIG. 1. FIG. 4A is a plan view, and FIG. 4B is a sectional view taken along line IVB-IVB of FIG. 4A.

The supporting substrate H1201 is formed by compression molding alumina ($Al_2O_3$) powder and then firing it. The thickness of the supporting substrate H1201 may be about 0.5 mm to 10 mm. The material forming the supporting substrate H1201 is not limited to alumina. The material forming the supporting substrate H1201 can have a linear expansion coefficient equal to that of the material forming the recording element substrates H1100 and H1101 and a thermal conductivity equal to or higher than that of the material forming the recording element substrates H1100 and H1101. Examples of the material forming the supporting substrate H1201 include aluminum nitride (AlN), silicone nitride ($Si_3N_4$), and silicon carbide (SiC).

The supporting substrate H1201 is provided with ink supply ports H6001 and H6002 for leading ink supplied from the ink supply unit H1003 (see FIG. 1) to the ink supply ports H1102 provided in the recording element substrates H1100 and H1101.

In addition, the supporting substrate H1201 has grooves H6003 formed in the vicinities of both ends in the longitudinal direction of the ink supply port H6001, and grooves H6004 formed in the vicinities of both ends in the longitudinal direction of the ink supply ports H6002. In other words, the grooves H6003 are provided in the vicinities of the two sides facing each other in the longitudinal direction, of the periphery of the surface on which the recording element substrate H1100 is provided, of the supporting substrate H1201; and the grooves H6004 are provided in the vicinities of the two sides facing each other in the longitudinal direction, of the periphery of the surface on which the recording element substrate H1101 is provided, of the supporting substrate H1201. The grooves H6003 each include a first potion H6003*a* and a pair of second portions H6003*b*, and the grooves H6004 each include a first potion H6004*a* and a pair of second portions H6004*b*.

The first portions H6003*a* of the grooves H6003 are disposed at both ends in the longitudinal direction of the ink supply port H6001 so as to face each other. The first portions H6004*a* of the grooves H6004 are disposed at both ends in the longitudinal direction of the ink supply ports H6002 so as to face each other. The pairs of second portions H6003*b* of the grooves H6003 extend a predetermined length from both ends of the first portions H6003*a*, in the longitudinal direction of the ink supply port H6001, toward each other. The pairs of second portions H6004*b* of the grooves H6004 extend a predetermined length from both ends of the first portions H6004*a*, in the longitudinal direction of the ink supply ports H6002, toward each other.

The width W2 of the second portions H6003*b* and H6004*b* of the grooves H6003 and H6004 is larger than the width W1 of the first portions H6003*a* and H6004*a* of the grooves H6003 and H6004.

FIGS. 5A, 5B, and 5C show a state where the recording element substrate H1100 and H1101 and the supporting plate H1202 are bonded to the supporting substrate H1201. FIG. 5A is a plan view, FIG. 5B is a sectional view taken along line VB-VB of FIG. 5A, and FIG. 5C is a sectional view taken along line VC-VC of FIG. 5A.

The supporting plate H1202 is bonded to the supporting substrate H1201 with first adhesive. The first adhesive can be resistant to ink. The recording element substrates H1100 and H1101 are bonded to the supporting substrate H1201 with second adhesive. Both the layer of first adhesive and the layer of second adhesive may have a thickness of 50 μm or less.

The supporting plate H1202 has a thickness equal to those of the recording element substrates H1100 and H1101 so that the height from the supporting substrate H1201 of the recording element substrates H1100 and H1101 is about equal to that of the electric wiring substrate H1300. Thus, the thickness of the supporting plate H1202 is also about 0.5 mm to 1.0 mm. The supporting plate H1202 is formed of alumina. However, the supporting plate H1202 may be formed of any material (ceramic material, metal material, or the like) as long as the material has a linear expansion coefficient equal to that of the material forming the supporting substrate H1201.

Openings H1204 and H1205 for exposing the recording element substrates are formed in the supporting plate H1202. The recording element substrates H1100 and H1101 are disposed in the openings H1204 and H1205. Thus, around the recording element substrates H1100 and H1101, and between the recording element substrates H1100 and H1101 and the supporting plate H1202, recesses H7001 and H7002 are formed. The bottoms of the recesses H7001 and H7002 are parts of the upper surface of the supporting substrate H1201. In the recesses H7001 and H7002, the distal ends of the second portions H6003*b* and H6004*b* of the grooves H6003 and H6004 are exposed.

In the state shown in FIGS. 5A to 5C, the ink supply ports H6001 and H6002 of the supporting substrate H1201 shown in FIGS. 4A and 4B communicate with the ink supply ports H1102 of the recording element substrates H1100 and H1101 shown in FIG. 2 and FIG. 3.

Figure 6:
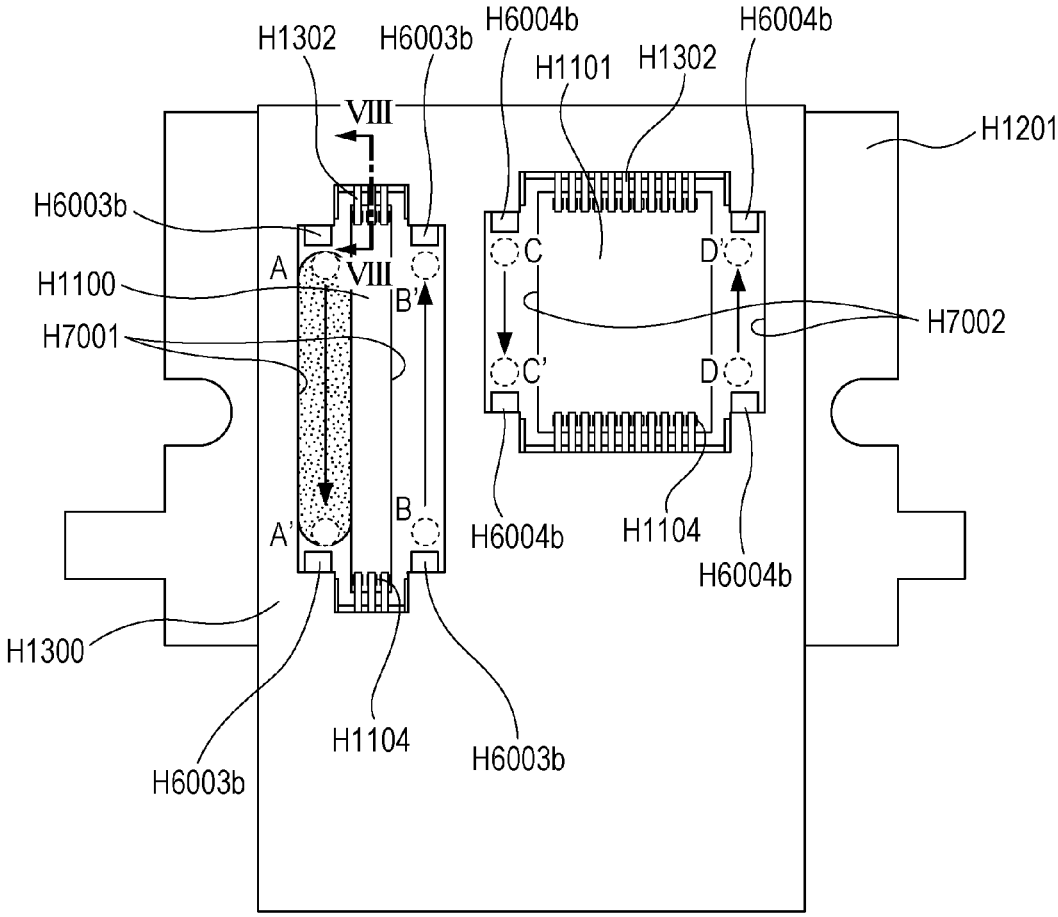
FIG. 6 is a diagram showing the state of the liquid ejection head shown in FIG. 1 during manufacturing.

FIG. 6 is a plan view showing a state where the electric wiring substrate H1300 is attached to the supporting plate H1202 shown in FIGS. 5A to 5C. Openings similar to the openings H1204 and H1205 of the supporting plate H1202 are formed in the electric wiring substrate H1300. The electric wiring substrate H1300 is positioned such that the openings of the electric wiring substrate H1300 are superimposed on the openings H1204 and H1205 of the supporting plate H1202, and is bonded to the supporting plate H1202 with third adhesive.

Although the recording element substrates H1100 and H1101 are separated from the electric wiring substrate H1300 by the recesses H7001 and H7002, the electrodes H1104 of the recording element substrates H1100 and H1101 are electrically connected to the electric wiring substrate H1300 by electrode terminals H1302 serving as connecting portions. The electrodes H1104 and the electrode terminals H1302 are connected, for example, by a thermal ultrasonic joining method.

The electrode terminals H1302 are disposed over the recesses H7001 and H7002 and transmit electric pulse signals from the recording apparatus main body, from the electric wiring substrate H1300 to the electrodes H1104 of the recording element substrates H1100 and H1101.

Next, a sealing resin layer forming method according to this embodiment will be described. The formation of sealing resin layers is performed in the state shown in FIG. 6.

Figure 7:
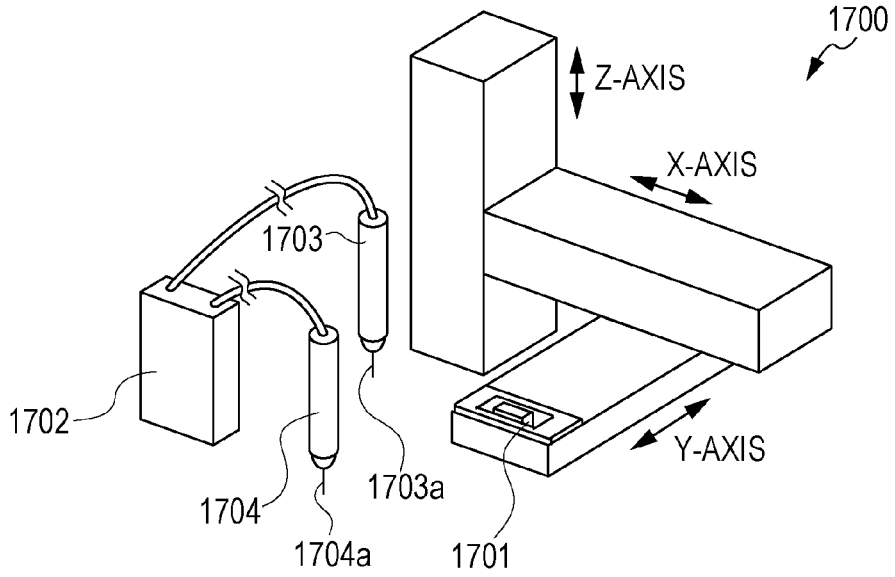
FIG. 7 is a schematic configuration diagram of a sealing resin application apparatus.

FIG. 7 is a perspective view showing the schematic configuration of a sealing resin application apparatus 1700 used in this embodiment. In the sealing resin application apparatus 1700, the assembly shown in FIG. 6, to which sealing resin is to be applied, is set on a stage 1701. The stage 1701 is movable in the X-axis direction, the Y-axis direction, and the Z-axis direction as shown by arrows.

The sealing resin application apparatus 1700 includes an ejection device 1702. A syringe 1703 filled with uncured first sealing resin H1307 and a syringe 1704 filled with uncured second sealing resin H1308 are connected to the ejection device 1702.

Needles 1703*a* and 1704*a* capable of ejecting uncured sealing resin are attached to the tips of the syringes 1703 and 1704. The external diameter of the needle 1703*a* is smaller than the width of the recesses H7001 and H7002. Specifically, the external diameter of the needle 1703*a* may be smaller than the width of the recesses H7001 and H7002 by about 0.2 mm to 0.6 mm.

With reference to FIG. 6, a method for filling the recesses H7001 and H7002 with uncured first sealing resin H1307 will be described.

First, the needle 1703*a* of the syringe 1703 is positioned over part A of the recess H7001 where there is no second portion H6003*b*. The distance between the tip of the needle 1703*a* and the upper surface of the electric wiring substrate H1300 may be about −0.2 mm to 0.3 mm. In this state, uncured first sealing resin H1307 is continuously ejected from the tip of the needle 1703*a*, and the needle 1703*a* is moved to part A'.

In this way, uncured first sealing resin H1307 is injected between part A and part A'. Similarly, uncured first sealing resin H1307 is injected between part B and part B', between part C and part C', and between part D and part D'. Since the bottoms of the recesses H7001 and H7002 between part A and part A', between part B and part B', between part C and part C', and between part D and part D' are flat, air can be prevented from being mixed into uncured first sealing resin H1307.

Thus, a decrease in print quality due to the adhesion of sealing resin to the recording element substrates due to the burst of bubbles of air mixed into sealing resin can be prevented, and a cost reduction due to the improvement of manufacturing yield can be achieved.

The uncured first sealing resin H1307 injected into the recesses H7001 and H7002 enters the grooves H6003 and H6004 from the distal ends of the second portions H6003*b* and H6004*b*, and the grooves H6003 and H6004 are filled with uncured first sealing resin H1307.

Since the second portions H6003*b* and H6004*b* of the grooves H6003 and H6004 are wider than the first portions H6003*a* and H6004*a*, uncured first sealing resin H1307 can easily enter the grooves H6003 and H6004. First sealing resin H1307 can have low viscosity and high fluidity when it is uncured.

Since the first portions H6003*a* and H6004*a* of the grooves H6003 and H6004 are narrow, owing to capillary action, uncured first sealing resin H1307 spreads easily throughout the grooves H6003 and H6004.

As described above, the first sealing resin injected into the recesses H7001 and H7002 fills the grooves H6003 and H6004 and fills the recesses H7001 and H7002.

Figure 8:
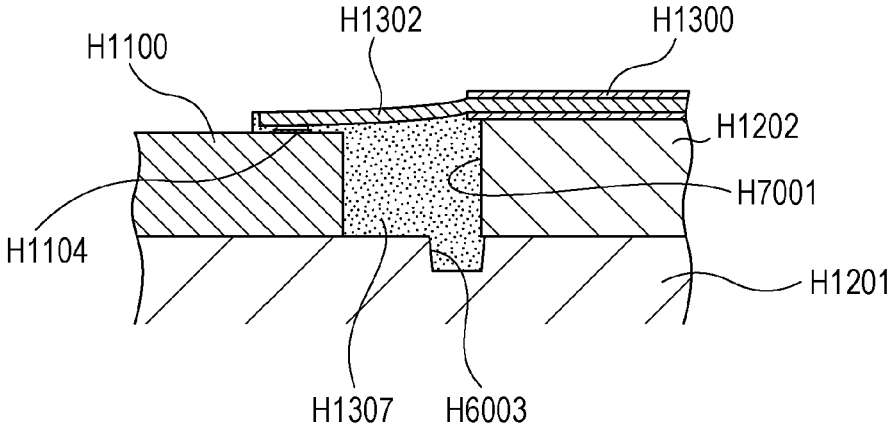
FIG. 8 is a sectional view taken along line VIII-VIII of FIG. 6.

FIG. 8 is a sectional view taken along line VIII-VIII of FIG. 6 after the recesses H7001 and H7002 are filled with uncured first sealing resin H1307. As shown in FIG. 8, uncured first sealing resin H1307 reaches the electrode terminals H1302 disposed over the recesses H7001 and H7002.

Since, in the state shown in FIG. 6, the distal ends of the second portions H6003*b* and H6004*b* are exposed in the recesses H7001 and H7002, uncured first sealing resin H1307 can quickly reach the electrode terminals H1302.

Figure 9:
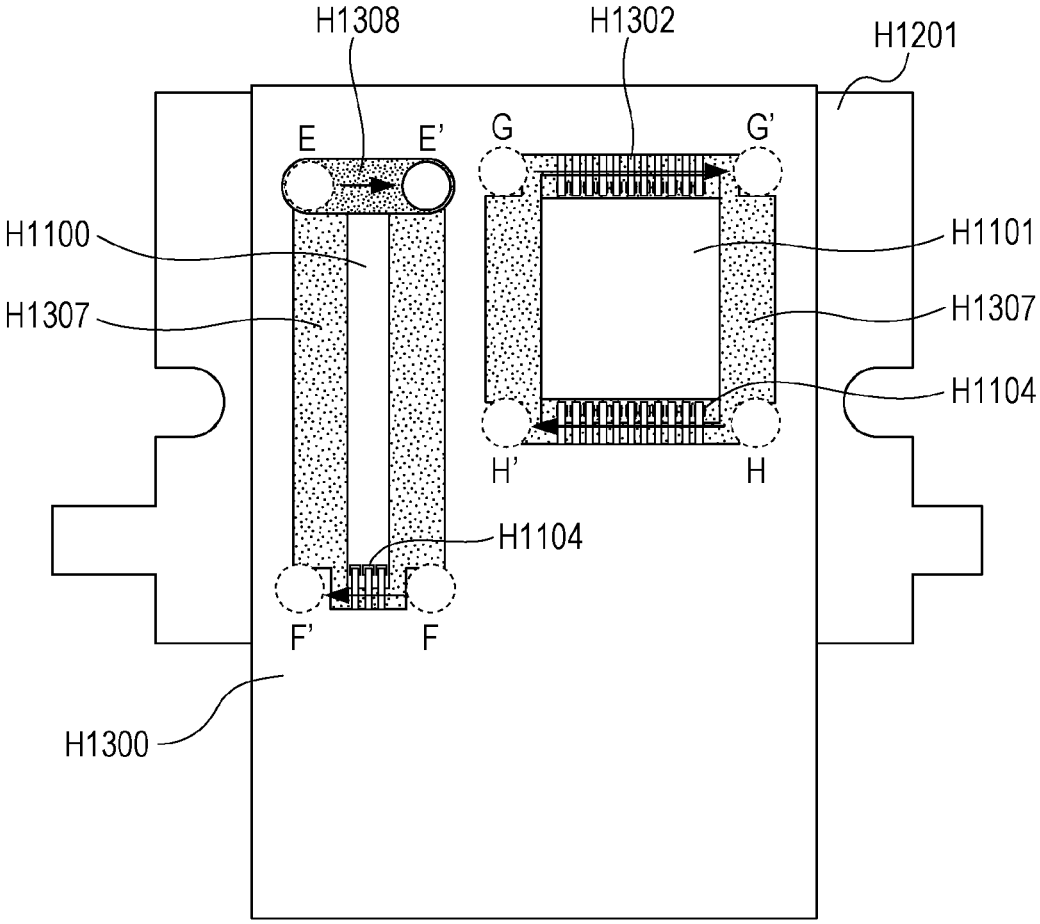
FIG. 9 is a diagram showing the state of the liquid ejection head shown in FIG. 1 during manufacturing.

After the recesses H7001 and H7002 have been filled with uncured first sealing resin H1307, uncured second sealing resin H1308 is applied with the syringe 1704 as shown in FIG. 9.

The tip of the needle 1704*a* of the syringe 1704 is positioned over part E and slightly above the electrode terminals H1302 shown in FIG. 8. In this state, uncured second sealing resin H1308 is continuously ejected from the tip of the needle 1704*a*, and the needle 1704*a* is moved to part E'.

In this way, uncured second sealing resin H1308 is applied between part E and part E'. Similarly, uncured second sealing resin H1308 is applied between part F and part F', between part G and part G', and between part H and part H'.

After that, first sealing resin H1307 and second sealing resin H1308 are cured by heating.

In this embodiment, first sealing resin H1307 and second sealing resin H1308 are thermosetting epoxy resins. A heating thermostatic bath is used for heating sealing resin. Sealing resins H1307 and H1308 can be cured at the same temperature.

Figure 10:
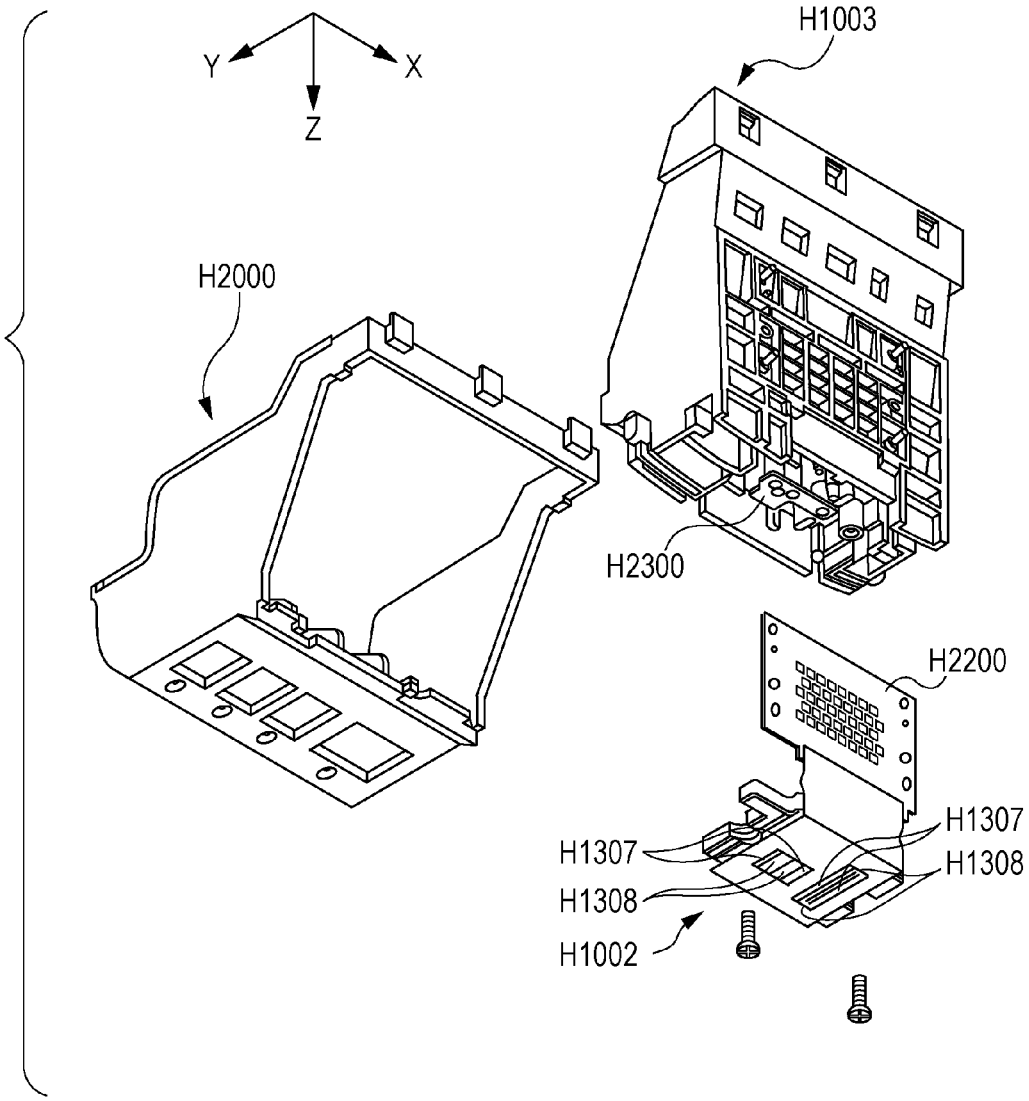
FIG. 10 is an exploded perspective view of the liquid ejection head shown in FIG. 1.
Figure 11A:
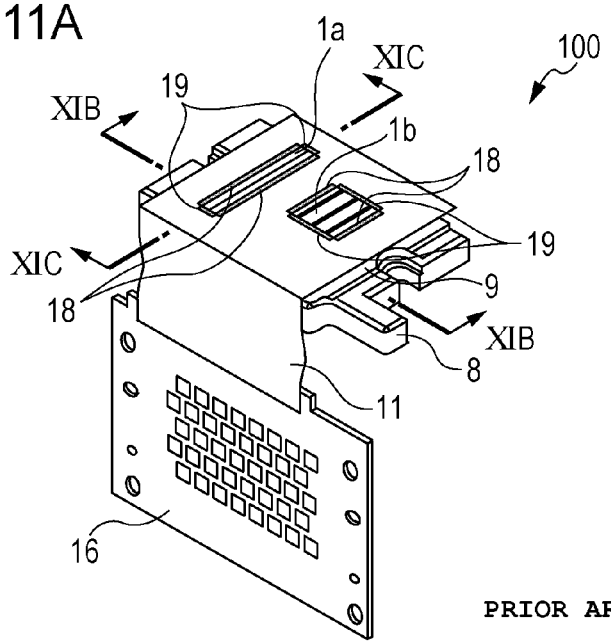
FIGS. 11A, 11B, and 11C are schematic configuration diagrams of a typical liquid ejection head.
Figure 11B:
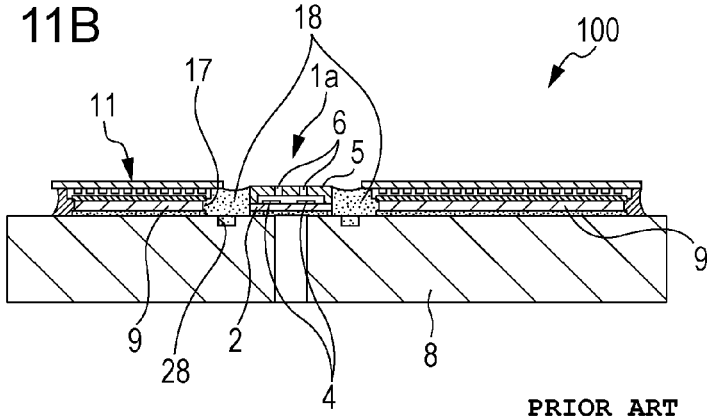
PRIOR ART FIG. 11B
Figure 11C:
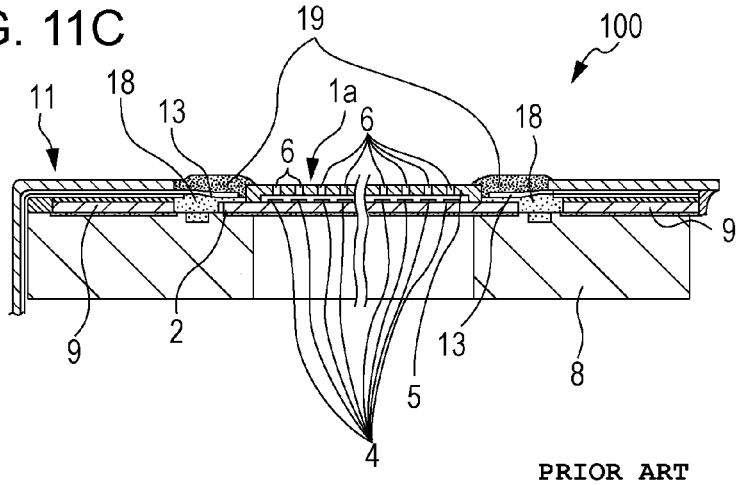
PRIOR ART FIG. 11C

FIG. 10 shows a state where the recording element unit H1002 and the ink supply unit H1003 are assembled. The recording element unit H1002, the ink supply unit H1003, and the tank holder H2000 are assembled into the liquid ejection head H1000.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-189346 filed Aug. 31, 2011, which is hereby incorporated by reference herein in its entirety.

What is claimed is:

1. A liquid ejection head comprising:

a recording element substrate including an ejection port that ejects liquid, and an energy generating element that generates energy used to eject liquid;

an electric wiring substrate including wiring for transmitting electric power for driving the energy generating element, and an opening that exposes the recording element substrate;

a plurality of connecting portions that electrically connect the recording element substrate and the electric wiring substrate;

a recess formed between the recording element substrate and the electric wiring substrate; and at least one groove formed in the bottom of the recess corresponding to at least one part where the connecting portions are formed, wherein the at least one groove includes a first portion formed along an arranging direction of the plurality of connecting portions, and a second portion formed in a direction intersecting with the arranging direction, wherein the width of the second portion of the at least one groove is larger than the width of the first portion of the at least one groove.

2. The liquid ejection head according to claim 1, wherein the recording element substrate has a rectangular surface in which the ejection port is formed, the first portion is formed along a first side of the surface on which the connecting portions are formed, and the second portion is formed along a second side adjacent to the first side.

3. The liquid ejection head according to claim 2, wherein the length of the second portion of the at least one groove is smaller than the length of the second side.

4. The liquid ejection head according to claim 2, wherein the length of the first portion of the at least one groove corresponds to the length of the first side.

5. The liquid ejection head according to claim 1, wherein a sealing material that covers the connecting portions is disposed in the at least one groove.

6. The liquid ejection head according to claim 5, wherein a sealing material different from the sealing material disposed in the at least one groove is disposed over the connecting portions.

7. The liquid ejection head according to claim 1, wherein the at least one groove comprises two grooves formed at both a first end of the recording element substrate and a second end on the opposite side of the first end.

8. The liquid ejection head according to claim 1, wherein the at least one groove is formed in a supporting substrate that supports the recording element substrate.

9. The liquid ejection head according to claim 1, further comprising a supporting plate that supports the electric wiring substrate.

* * * * *